US011478066B2

(12) United States Patent
Parsons et al.

(10) Patent No.: US 11,478,066 B2
(45) Date of Patent: Oct. 25, 2022

(54) BATON SCABBARD

(71) Applicant: Armament Systems and Procedures, Inc., Appleton, WI (US)

(72) Inventors: Kevin Parsons, Appleton, WI (US); Siu Ngai Wang, Kowloon (HK)

(73) Assignee: ARMAMENT SYSTEMS AND PROCEDURES, INC., Appleton, WI (US)

( * ) Notice: Subject to any disclaimer, the term of this patent is extended or adjusted under 35 U.S.C. 154(b) by 0 days.

(21) Appl. No.: 17/145,789

(22) Filed: Jan. 11, 2021

(65) Prior Publication Data

US 2022/0218093 A1 Jul. 14, 2022

(51) Int. Cl.

| | |
|---|---|
| ***F41C 33/02*** | (2006.01) |
| ***A45F 5/02*** | (2006.01) |
| *F41B 15/02* | (2006.01) |

(52) U.S. Cl.

CPC ..... *A45F 5/02* (2013.01); *A45F 2200/0566* (2013.01); *F41B 15/022* (2013.01)

(58) Field of Classification Search

CPC ..... F41C 33/0263; F41C 33/0227; A45F 2200/0591; A45F 2005/025; A45F 5/021; A45F 2200/0566; Y10T 16/540247; Y10T 16/540256; Y10T 16/540257

USPC ..... 224/242–243, 197

See application file for complete search history.

(56) References Cited

U.S. PATENT DOCUMENTS

| | | | | |
|---|---|---|---|---|
| 4,600,133 | A * | 7/1986 | Maihos | B26B 29/025 224/232 |
| 5,501,381 | A * | 3/1996 | Rogers | F41C 33/0272 224/238 |
| 6,889,878 | B2 * | 5/2005 | Parsons | A45F 5/02 224/678 |
| 8,104,656 | B1 * | 1/2012 | George | F42B 39/02 224/684 |
| 8,308,033 | B2 * | 11/2012 | Case | A45F 5/02 224/250 |
| 9,726,457 | B2 * | 8/2017 | Parsons | A45F 5/021 |
| 10,362,856 | B2 | 7/2019 | Parsons et al. | |
| 2007/0181619 | A1 * | 8/2007 | Seyfert | F41C 33/0227 224/912 |
| 2007/0278266 | A1 * | 12/2007 | Parsons | F41B 15/02 224/914 |
| 2015/0323285 | A1 * | 11/2015 | McKendrick | F41C 33/045 224/198 |

* cited by examiner

*Primary Examiner* — Adam J Waggenspack

(74) *Attorney, Agent, or Firm* — Hahn Loeser & Parks LLP

(57) ABSTRACT

A scabbard for carrying a collapsed baton is described. The scabbard comprises a rotatable protective hood.

19 Claims, 12 Drawing Sheets

BATON SCABBARD

FIELD OF THE INVENTION

This application is directed to a scabbard for carrying a collapsed baton, and to a scabbard that comprises a rotatable protective hood.

BRIEF DESCRIPTION OF THE DRAWINGS

While embodiments can take many different forms, specific embodiments are shown in the drawings and will be described with the understanding that the present disclosure is an exemplification of the principles of the present invention and the best mode of practicing it. No limitation to a specific embodiment illustrated is intended. The following drawings are not necessarily drawn to scale.

DETAILED DESCRIPTION OF ILLUSTRATED EMBODIMENT

Figure 2:
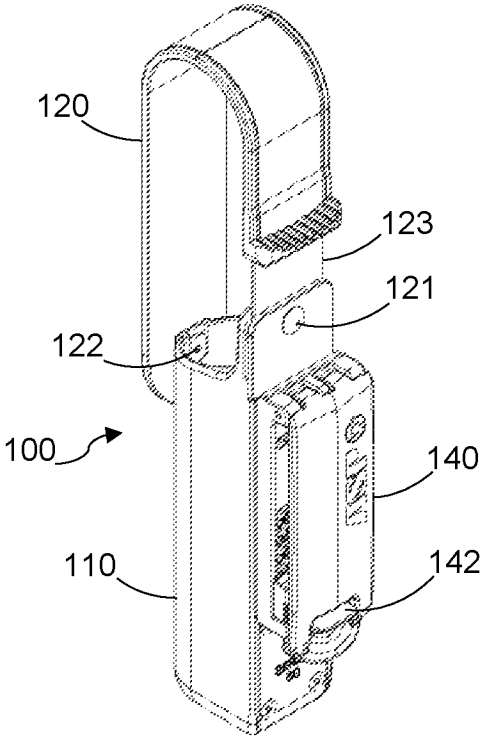
FIG. 2 is a rear perspective view of the embodiment of FIG. 1, with the hood in the closed position.
Figure 1:
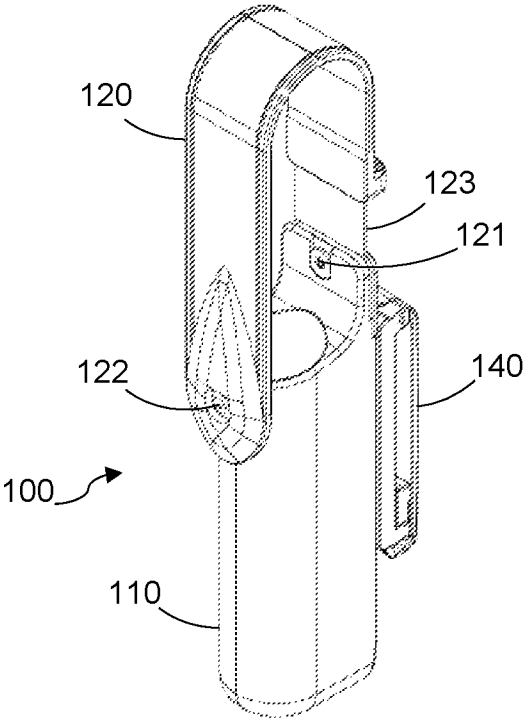
FIG. 1 is a front perspective view of an exemplary embodiment of a baton scabbard, with the hood in the closed position.
Figure 3:
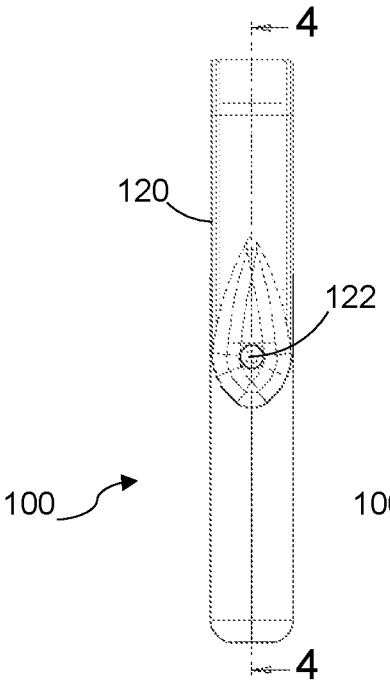
FIG. 3 is a front view of the embodiment of FIG. 1, with the hood in the closed position.
Figure 4:
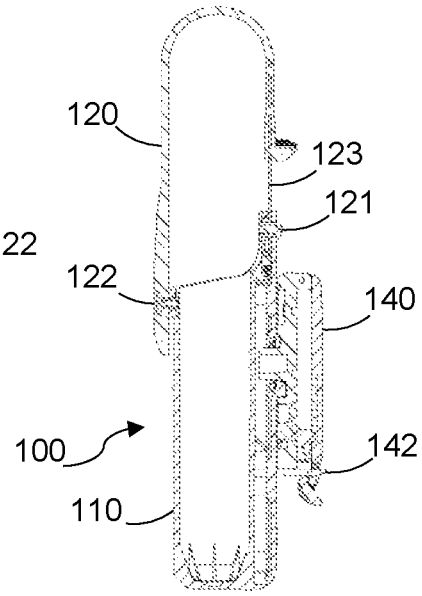
FIG. 4 is a cross-sectional view taken along line 4-4 of FIG. 3.
Figure 5:
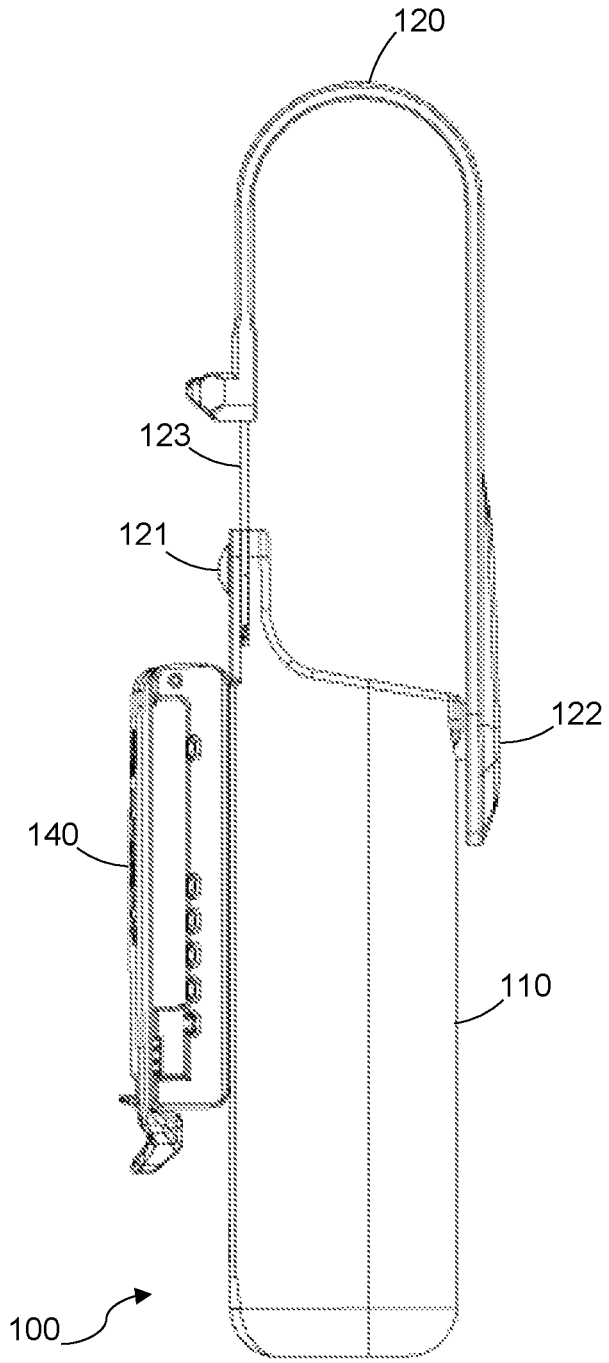
FIG. 5 is a right side view of the embodiment of FIG. 1, with the hood in the closed position.
Figure 6:
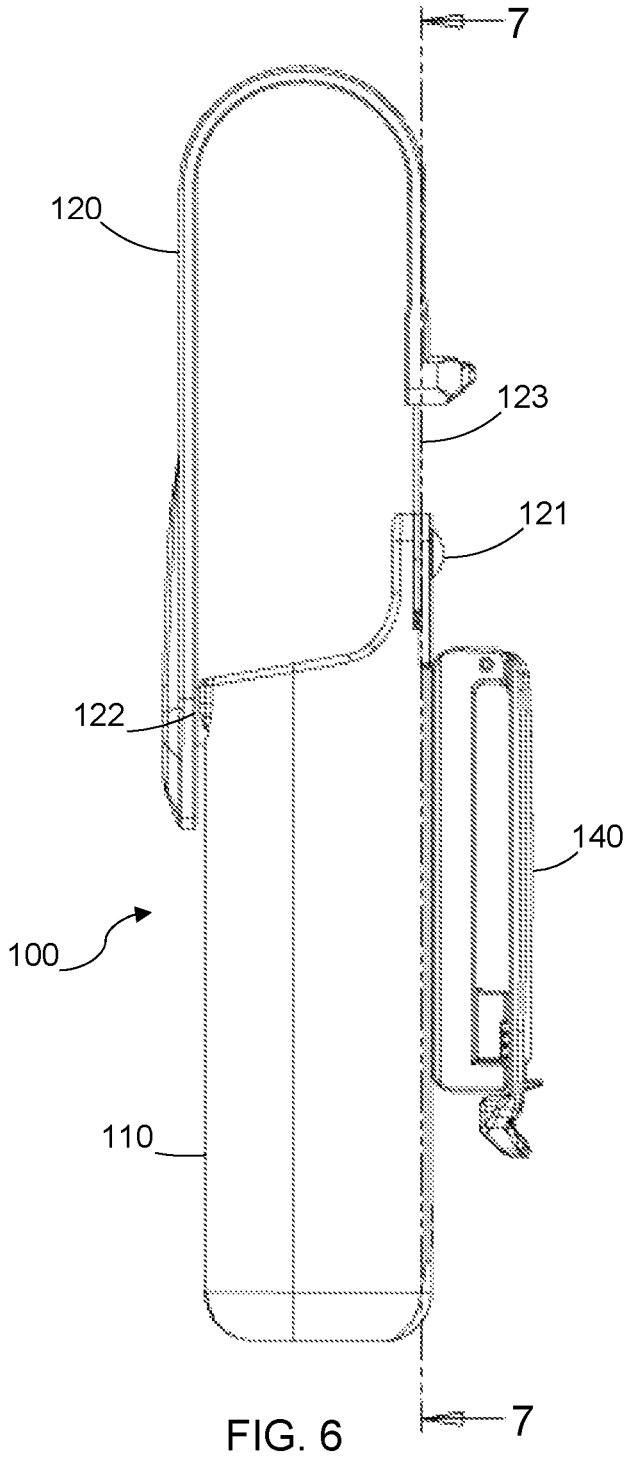
FIG. 6 is a left side view of the embodiment of FIG. 1, with the hood in the closed position.
Figure 7:
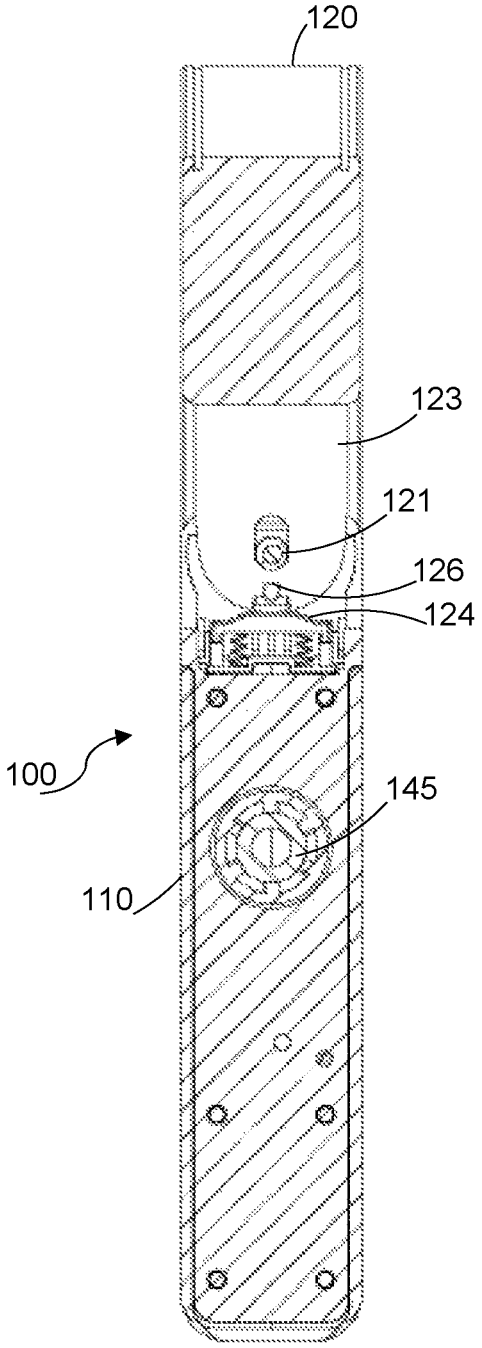
FIG. 7 is a cross-sectional view taken along line 7-7 of FIG. 6.
Figure 8:
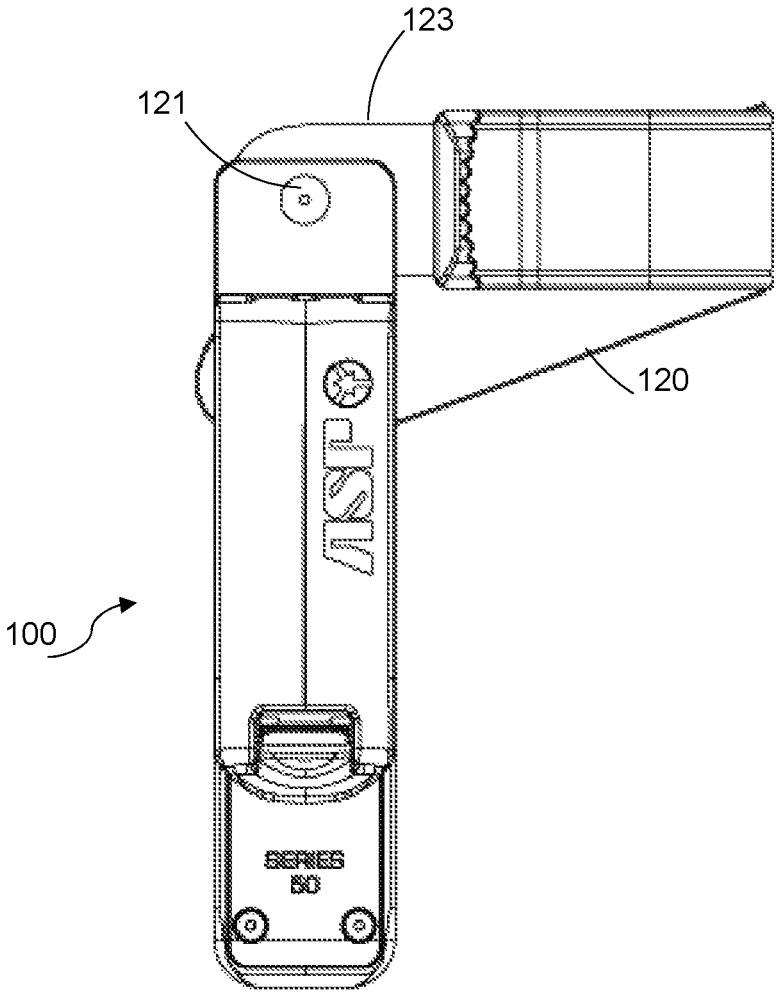
FIG. 8 is a rear view of the embodiment of FIG. 1, with the hood rotated about 90° from the closed position.
Figure 9:
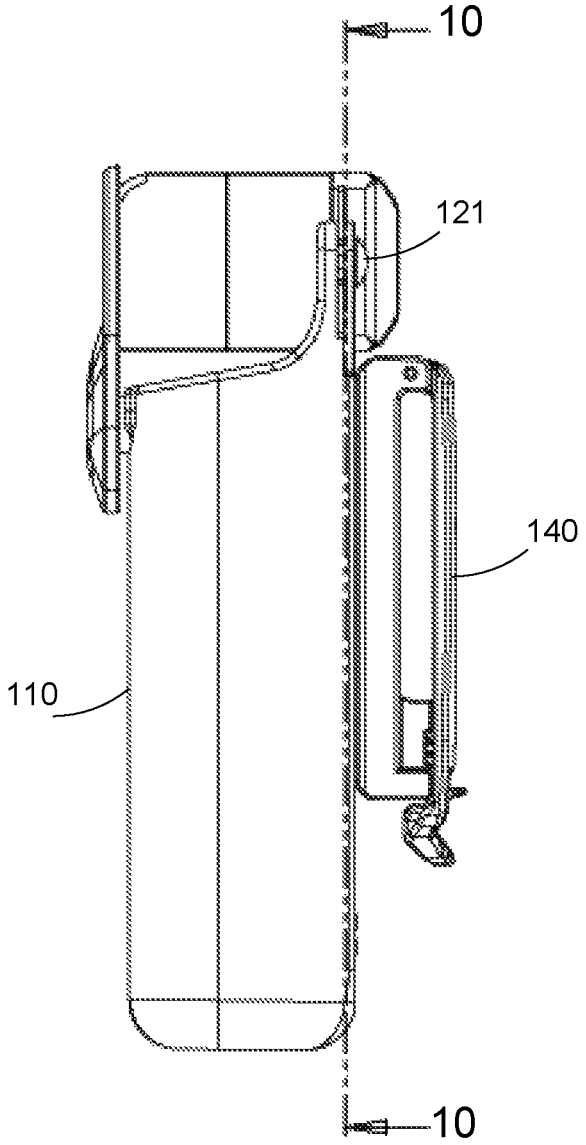
FIG. 9 is a left side view of the embodiment of FIG. 1, with the hood rotated about 90° from the closed position.
Figure 10:
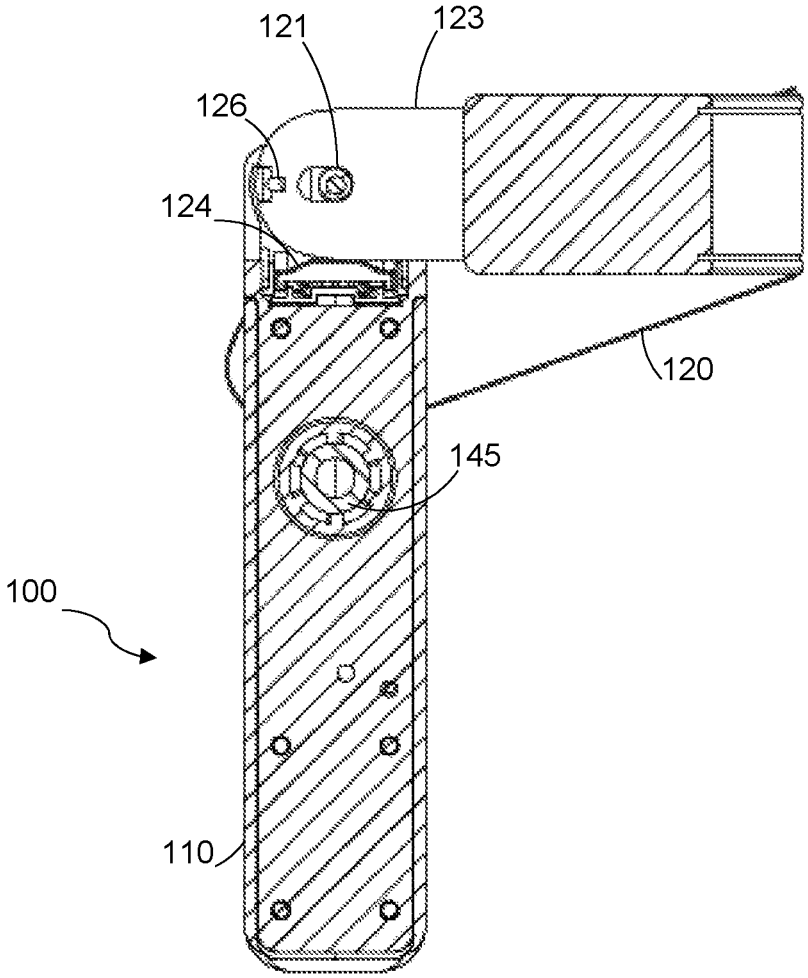
FIG. 10 is a cross-sectional view taken along line 10-10 of FIG. 9.
Figure 11:
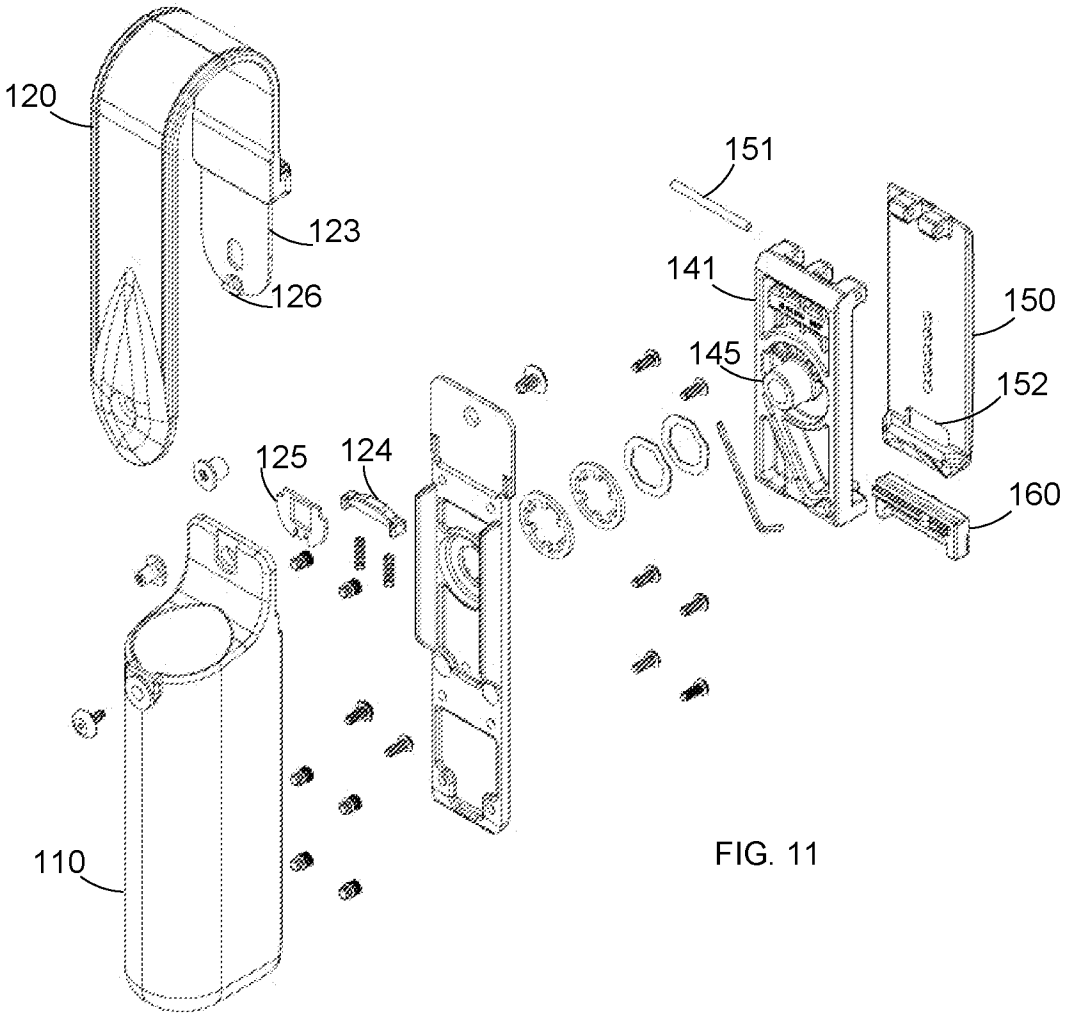
FIG. 11 shows the components of the embodiment of FIG. 1.

FIGS. 1-3, 5 and 6 show, respectively, front perspective, rear perspective, front, right side and left side views of an exemplary embodiment of a baton scabbard 100, with a protective hood 120 in a closed position. FIGS. 8 and 9 show, respectively, rear and left side views of that exemplary embodiment, with the protective hood 120 rotated about 90° from the closed position. FIG. 4 is a cross-sectional view taken along line 4-4 of FIG. 3. FIG. 7 is a cross-sectional view taken along line 7-7 of FIG. 6. FIG. 10 is a cross-sectional view taken along line 10-10 of FIG. 9. FIG. 11 show the components of the exemplary embodiment of FIG. 1.

In the illustrated example, the baton scabbard 100 comprises a body 110, which is a tube-like structure for receiving a collapsed baton. Preferably, the body 110 comprises a hard plastic. The baton scabbard 100 facilitates carrying a baton securely, while providing quick access to the baton. Therefore, when the protective hood 120 is in a closed position, it covers a top and two sides of a baton that is received in the body 110 but can be rotated out of the way quickly to allow the baton to be removed from the baton scabbard 100.

In the illustrated example, one end of the protective hood 120 is rotatably mounted about a first pivot 121 and the other end of the protective hood 120 is rotatably mounted about a second pivot 122. Preferably, the protective hood 120 is rotatable, from the closed position, both clockwise and counterclockwise about the first and second pivots 121 and 122, such that the protective hood 120 twists when it is rotated from the closed position, as shown in FIGS. 8 and 10. The protective hood 120 preferably comprises a polymer, and is substantially U-shaped between the first and second pivots 121 and 122. The term "U-shaped" is used broadly, in this description and in the claims, to mean extending up from the first pivot 121, over a baton that is received in the body 110, and down to the second pivot 122. The term "U-shaped" can include a rounded shape as best seen in FIGS. 1, 2, 4, 5, 6 and 11, as well as other shapes such a one with squared corners and a flat top or one with a V-shaped pointed top, for example.

Quick access to a baton that is fully inserted into the body 110 of a baton scabbard 100 is facilitated if enough of the fully inserted baton extends above at least part of the body 110 for a user to grasp the baton comfortably. Accordingly, when the protective hood 120 is in a closed position, it extends above the second pivot 122 at least 9 cm, preferably at least 10 cm, and at least 11 cm in some examples.

Preferably, the protective hood 120 is locked in the closed position to facilitate carrying a baton securely, but it can be rotated out of the closed position quickly and easily. In the illustrated embodiment, the protective hood 120 is locked in the closed position until it is depressed down, after which it is rotatable away from the closed position.

In the illustrated embodiment, the protective hood 120 comprises a rigid portion 123 about the first pivot 121. In other embodiments, there may be a rigid portion about the second pivot or there may be rigid portions about both pivots.

In the illustrated embodiment, the baton scabbard 100 comprises a spring-loaded mechanism 124 that biases the rigid portion 123 to rise higher above the first pivot 121. As best seen in FIG. 11, the baton scabbard 100 also comprises a locking coupler 125, and the rigid portion 123 comprises a locking mechanism 126. The locking mechanism 126 engages the locking coupler 125 when the protective hood 120 is in the closed position, unless the protective hood 120 is depressed down against the bias of the spring-loaded mechanism 124. This engagement of the locking mechanism 126 and the locking coupler 125 prevents rotation of the protective hood 120 from the closed position. When the rigid portion 123 is depressed down against the bias of the spring-loaded mechanism 124, the locking mechanism 126 disengages from the locking coupler 125 permitting rotation of the protective hood 120.

In the illustrated embodiment, the locking coupler 125 comprises a recess, and the locking mechanism 126 comprises a tab that is positioned and dimensioned to mate with the locking coupler 125 to effect the engagement of the locking mechanism 126 with the locking coupler 125. In other embodiments, the locking mechanism may comprise a recess and the locking coupler may comprise a tab, or those components may comprise other mating features as is known in the art such as interlocking protrusions, hooks, teeth, gears, and so forth.

In some embodiments, the baton scabbard 100 comprises an attachment means for attaching the baton scabbard 100 to a user's clothing, for example. Examples of an attachments means include a clip, a loop, a hook, a clasp, a button, and other fastening features as are known in the art. As some examples, the attachment means can be used to attach the baton scabbard 100 to a user's belt or to a MOUE (Modular Lightweight Load-Carrying Equipment) vest. In some examples, the attachment means is an injection molded polymer.

Figure 12:
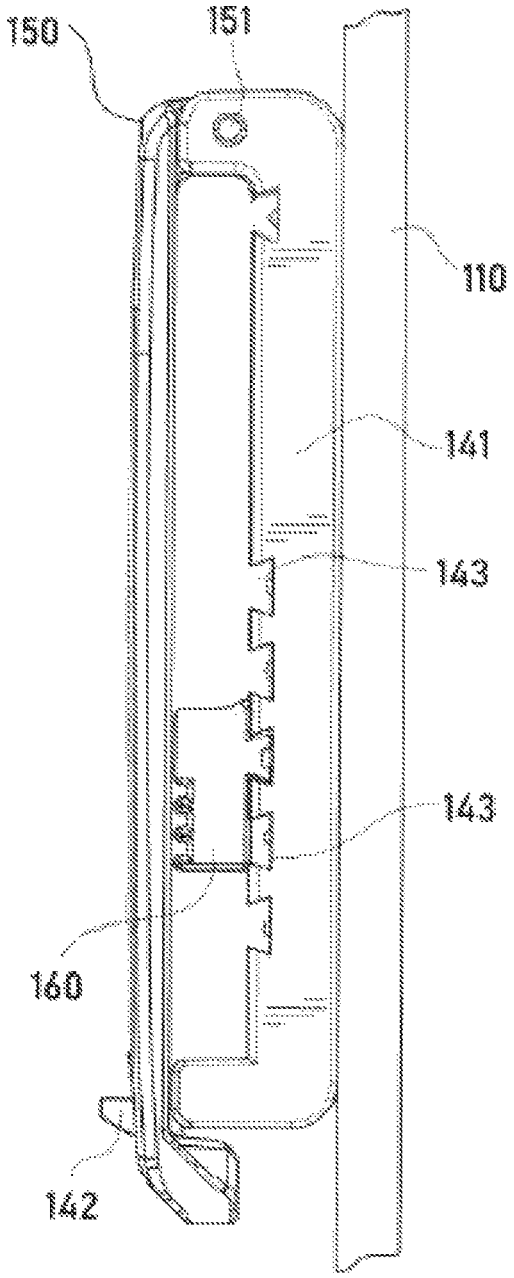
FIG. 12 is an enlarged side view of a clip on the rear of the exemplary embodiment of FIG. 1.
Figure 13:
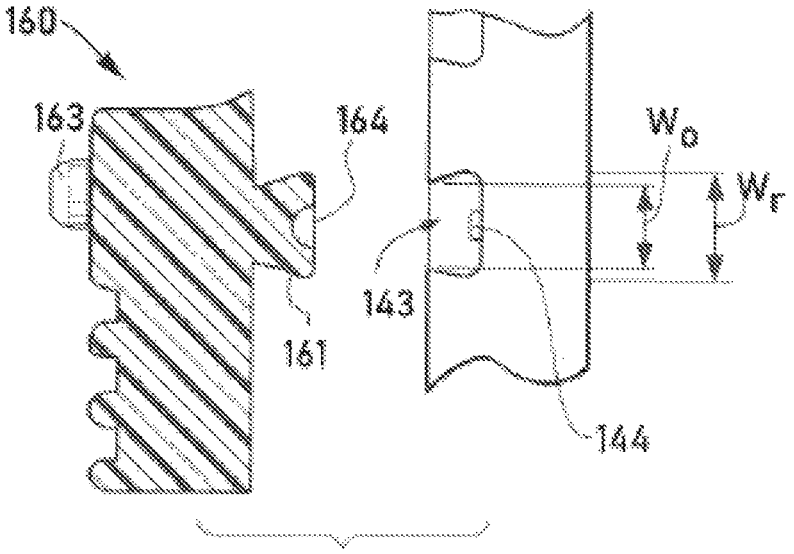
FIG. 13 is an enlarged view of an adjustable spacer shown in FIG. 12, and of a portion of a mounting plate into which the adjustable spacer is installed as shown in FIG. 12.
Figure 14:
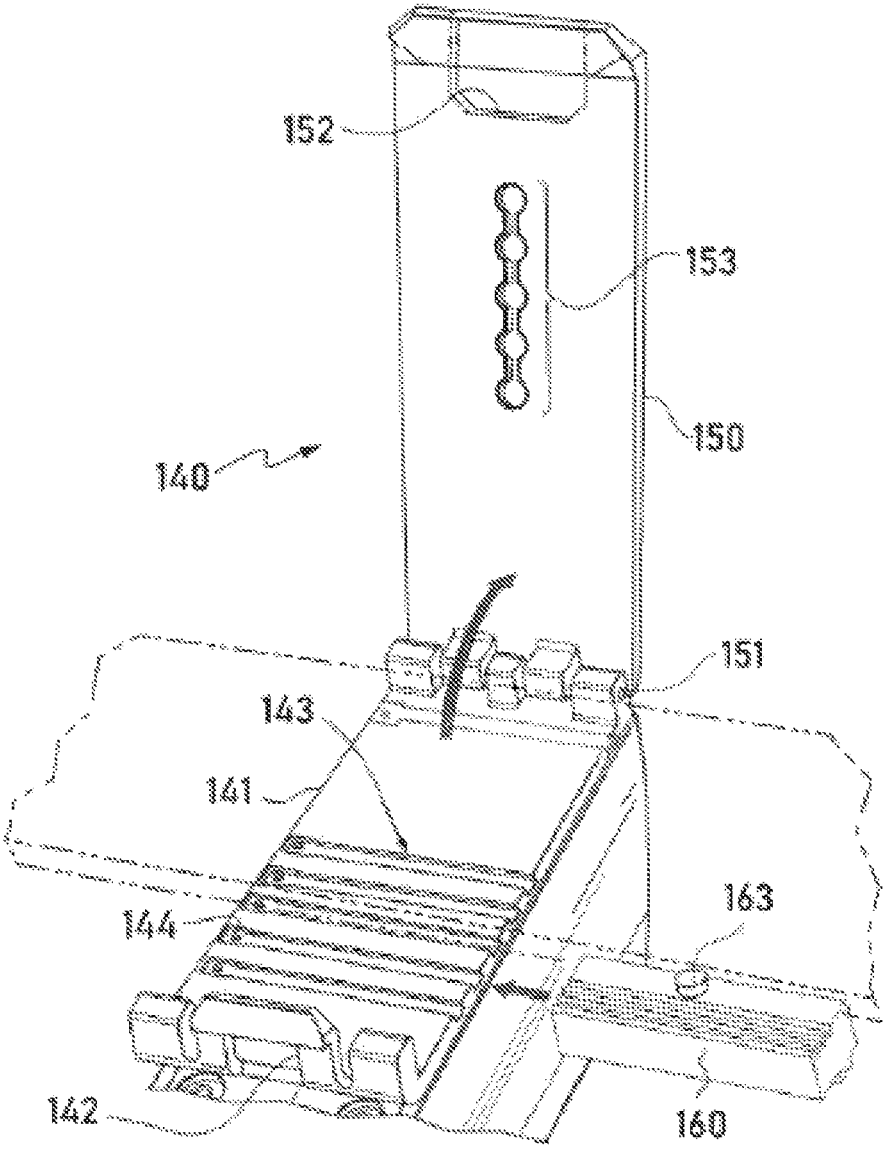
FIG. 14 is a perspective view of the clip of FIG. 12, with the clip open.

In the illustrated embodiment, the attachment means is a clip 140 that adjoins one side of the body 110. FIG. 12 is an enlarged side view of the clip 140, FIG. 13 is an enlarged view of an adjustable spacer 160 to accommodate attachment of the clip 140 to a plurality of different size items. For example, spacer 160 may be adjusted to accommodate attachment of the clip 140 to 1.25", 1.50", 1.75", 2.00" or 2.25" belts and so forth. FIG. 14 is a perspective view of the clip 140 in an open position. The clip 140 comprises a mounting plate 141 and a cover plate 150 that are joined at a first longitudinal end by a hinge 151. A resilient locking arm 142 that is located at an opposite second longitudinal end of the mounting plate 141 releasably engages with an aperture 152 at the second longitudinal end of the cover plate 150 to lock the clip 140 closed. In some examples, a mounting plate 141 is integral with the body 110.

In the illustrated example, a number of slots 143 extend across the mounting plate 141, and an adjustable spacer 160 is releasably installed in one of the slots 143. The width $w_r$ at a root of each slot 143 is greater than the width $w_o$ at the opening of each slot 143, and the width of an engaging portion 161 of the adjustable spacer 160 varies similarly and is sized to fit snugly into any of the slots 143. The adjustable spacer 160 also is held in place because a dimple 164 at the end of the engaging portion 161 engages with one of the bumps 144 that are located at the blind end of each slot 143, respectively, and because a peg 163 on the top of the adjustable spacer 160 engages with one of the apertures 153 in the cover plate 150.

Figure 15:
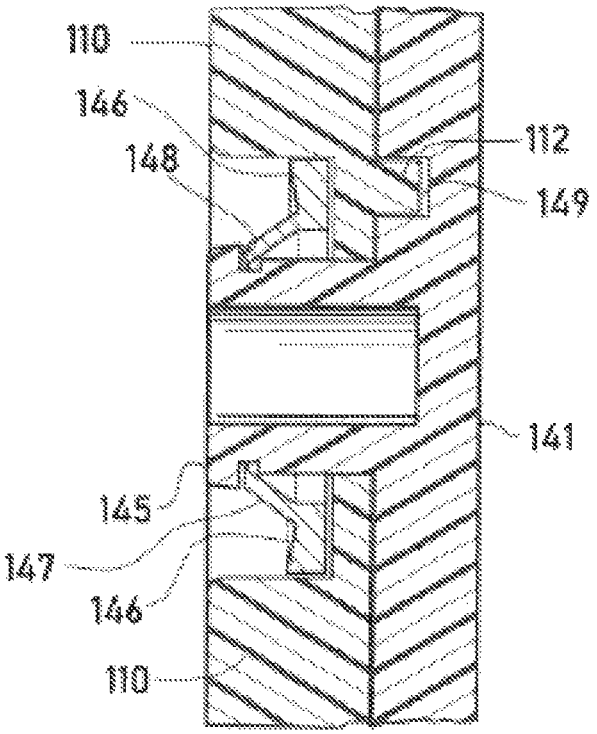
FIG. 15 is an enlarged cross-sectional view of a pivotal joint rotatably joining the clip to the body of the embodiment of FIG. 1.

In some embodiments, the baton scabbard 100 comprises a pivoting joint rotatably joining the clip 140 to the body 110. In the example of FIG. 15, the mounting plate 141 includes a hub 145 that extends through an aperture in the body 110. A retaining ring 146 is slid over the hub 145 and resilient projections 147 on an inner diameter of the retaining ring 146 engage one or more slots 148 on the hub 145 to secure the retaining ring 146 to the mounting plate 141. Various resilient projections and slots in the retaining ring 146 and the body 110 facilitate retention of the baton scabbard 100 at any one of a plurality of predetermined orientations with respect to the clip 140. In that way, the baton scabbard 100 can be reoriented such as because a user is sitting rather than standing, and so forth. A post 112 in the body 110 engages an arcuate slot 149 in the mounting plate 141 to allow rotation of the body 110 relative to the clip 140 only through a predetermined arc.

It will be understood that the disclosed baton scabbard can be modified without departing from the teachings of the invention. Accordingly, the scope of the invention is only to be limited as necessitated by the accompanying claims.

What is claimed is:

1. A baton scabbard, comprising:

a body for receiving a collapsed baton, the body having a first side and other sides;

a rotatable protective hood, the hood being rotatably mounted to the first side about a first pivot and being rotatably mounted to one of the other sides about a second pivot, the hood being substantially U-shaped between the first and second pivots, and the hood being rotatable, from a closed position, both clockwise and counterclockwise about the first and second pivots, the closed position being a position in which the hood covers a top and two sides of the collapsed baton that is received in the body; wherein the hood twists as the hood is rotated from the closed position; and an attaching means adjoining the first side, for attaching the scabbard to a user's clothing.

2. The scabbard of claim 1, the hood being locked in a closed position until being depressed down, and being rotatable away from the closed position after being depressed down, the closed position being a position in which the hood covers a top and two sides of the collapsed baton that is received in the body.

3. The scabbard of claim 1, further comprising:

a spring-loaded mechanism; and a locking coupler; and wherein the hood comprises a rigid portion about one of the first and second pivots, and the spring-loaded mechanism biases the rigid portion to rise higher above the one of the first and second pivots;

wherein the rigid portion comprises a locking mechanism, the locking mechanism engaging the locking coupler when the hood is in a closed position unless the hood is depressed down against the bias of the spring-loaded mechanism, and engagement of the locking mechanism with the locking coupler prevents rotation of the hood from the closed position, the closed position being a position in which the hood covers a top and two sides of the collapsed baton that is received in the body; and wherein the locking mechanism disengages from the locking coupler when the rigid portion is depressed down against the bias of the spring-loaded mechanism, permitting rotation of the hood.

4. The scabbard of claim 3, the locking coupler comprising a recess; and the locking mechanism comprising a tab that is positioned and dimensioned to mate with the recess of the locking coupler to effect the engagement of the locking mechanism with the locking coupler.

5. The scabbard of claim 1, the hood extending at least 9 cm above the second pivot when the hood is in a closed position, the closed position being a position in which the hood covers a top and two sides of the collapsed baton that is received in the body.

6. The scabbard of claim 1, the hood extending at least 10 cm above the second pivot when the hood is in the closed position, the closed position being a position in which the hood covers a top and two sides of the collapsed baton that is received in the body.

7. The scabbard of claim 1, the hood extending at least 11 cm above the second pivot when the hood is in the closed position, the closed position being a position in which the hood covers a top and two sides of the collapsed baton that is received in the body.

8. The scabbard of claim 1, the hood comprising a polymer.

9. The scabbard of claim 1, the body comprising a hard plastic.

10. The scabbard of claim 1, the attaching means being selected from a group consisting of a clip, a loop, a hook, a clasp, and a button.

11. The scabbard of claim 1, the attaching means comprising a clip.

12. The scabbard of claim 11, the scabbard further comprising a pivoting joint that rotatably joins the clip to the body.

13. The scabbard of claim 12, the pivoting joint allowing rotation of the clip relative to the body only through a predetermined arc.

14. The scabbard of claim 12, the pivoting joint comprising projections and slots that facilitate retention of the body at any one of a plurality of predetermined orientations with respect to the clip.

15. The scabbard of claim 11, the clip comprising an adjustable spacer to accommodate attachment of the clip to a plurality of different size items.

16. The scabbard of claim 1, the hood being rotatable from a central position about 90° both clockwise and counterclockwise about the first and second pivots.

17. The scabbard of claim 1, wherein the second pivot is offset and above the first pivot on the body.

18. The scabbard of claim 1, the hood being rotatable at the second pivot at a different rate than the first pivot.

19. The scabbard of claim 1, wherein the substantially U-shaped hood is asymmetrical at opposing ends.

* * * * *